US006324787B1

(12) United States Patent
Burr

(10) Patent No.: US 6,324,787 B1
(45) Date of Patent: Dec. 4, 2001

(54) ADAPTER FOR ELECTRIC GARAGE DOOR OPENERS

(76) Inventor: Richie Burr, 2135 E. College Ave., Visalia, CA (US) 93292

( * ) Notice: Subject to any disclaimer, the term of this patent is extended or adjusted under 35 U.S.C. 154(b) by 0 days.

(21) Appl. No.: 09/637,677

(22) Filed: Aug. 14, 2000

(51) Int. Cl.[7] ..... E05C 7/06
(52) U.S. Cl. ..... 49/109; 49/118; 49/199
(58) Field of Search ..... 49/116, 118, 104, 49/109, 122, 197, 199, 139, 140

(56) References Cited

U.S. PATENT DOCUMENTS 835,984 * 11/1906 Reis ..... 49/109
1,410,314 * 3/1922 Hyatt ..... 49/118 X
1,440,055 * 12/1922 Campbell ..... 49/118 X
1,478,601 * 12/1923 Davis ..... 49/118 X
1,804,231 * 5/1931 Rantz ..... 49/109 X
1,900,176 * 3/1933 Flewell ..... 49/109
2,032,803 * 3/1936 Hunter ..... 49/109
5,588,257 * 12/1996 Duhame et al. ..... 49/199

* cited by examiner

*Primary Examiner*—Jerry Redman
(74) *Attorney, Agent, or Firm*—Goldstein Law Offices, P.C.

(57) ABSTRACT

An adapter for electric garage door openers including a sliding portion adapted for coupling with the track of the electric garage door opener. A pair of support bars extend between the sliding portion and the pair of outwardly opening garage doors.

2 Claims, 3 Drawing Sheets

ADAPTER FOR ELECTRIC GARAGE DOOR OPENERS

BACKGROUND OF THE INVENTION

The present invention relates to an adapter for electric garage door openers and more particularly pertains to allowing a standard electric garage door opener to open and close a pair of outwardly opening garage doors.

The use of garage door openers is known in the prior art. More specifically, garage door openers heretofore devised and utilized for the purpose of opening garage doors are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe an adapter for electric garage door openers for allowing a standard electric garage door opener to open and close a pair of outwardly opening garage doors.

In this respect, the adapter for electric garage door openers according to the present invention substantially departs from the conventional concepts and designs of the prior art, and in doing so provides an apparatus primarily developed for the purpose of allowing a standard electric garage door opener to open and close a pair of outwardly opening garage doors.

Therefore, it can be appreciated that there exists a continuing need for a new and improved adapter for electric garage door openers which can be used for allowing a standard electric garage door opener to open and close a pair of outwardly opening garage doors. In this regard, the present invention substantially fulfills this need.

SUMMARY OF THE INVENTION

In the view of the foregoing disadvantages inherent in the known types of garage door openers now present in the prior art, the present invention provides an improved adapter for electric garage door openers. As such, the general purpose of the present invention, which will be described subsequently in greater detail, is to provide a new and improved adapter for electric garage door openers which has all the advantages of the prior art and none of the disadvantages.

To attain this, the present invention essentially comprises a sliding portion adapted for coupling with the track of the electric garage door opener. The sliding portion includes a vertical plate and a horizontal plate. The vertical plate has an upper end and a lower end. The horizontal plate has an upper surface and a lower surface. The lower end of the vertical plate is secured to the upper surface of the horizontal plate whereby the vertical plate extends upwardly from the horizontal plate in an orthogonal relationship. The sliding portion includes a sliding member slidably coupled with the upper end of the vertical plate. The sliding member has an upper end coupled with the track of the electric garage door opener. The sliding member has a cylindrical member extending downwardly therefrom. The cylindrical member has a release rope secured thereto whereby pulling on the rope will release the sliding member from the track. A pair of support bars extend between the sliding portion and the pair of outwardly opening garage doors. The support bars each have inner ends pivotally coupled with the lower surface of the horizontal plate of the sliding portion. The support bars each have outer ends pivotally coupled with the garage doors.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adapter for electric garage door openers which has all the advantages of the prior art garage door openers and none of the disadvantages.

It is another object of the present invention to provide a new and improved adapter for electric garage door openers which may be easily and efficiently manufactured and marketed.

It is a further object of the present invention to provide a new and improved adapter for electric garage door openers which is of durable and reliable construction.

An even further object of the present invention is to provide a new and improved adapter for electric garage door openers which is susceptible of a low cost of manufacture with regard to both materials and labor, and which accordingly is then susceptible of low prices of sale to the consuming public, thereby making such an adapter for electric garage door openers economically available to the buying public.

Even still another object of the present invention is to provide a new and improved adapter for electric garage door openers for allowing a standard electric garage door opener to open and close a pair of outwardly opening garage doors.

Lastly, it is an object of the present invention to provide a new and improved adapter for electric garage door openers including a sliding portion adapted for coupling with the track of the electric garage door opener. A pair of support bars extend between the sliding portion and the pair of outwardly opening garage doors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
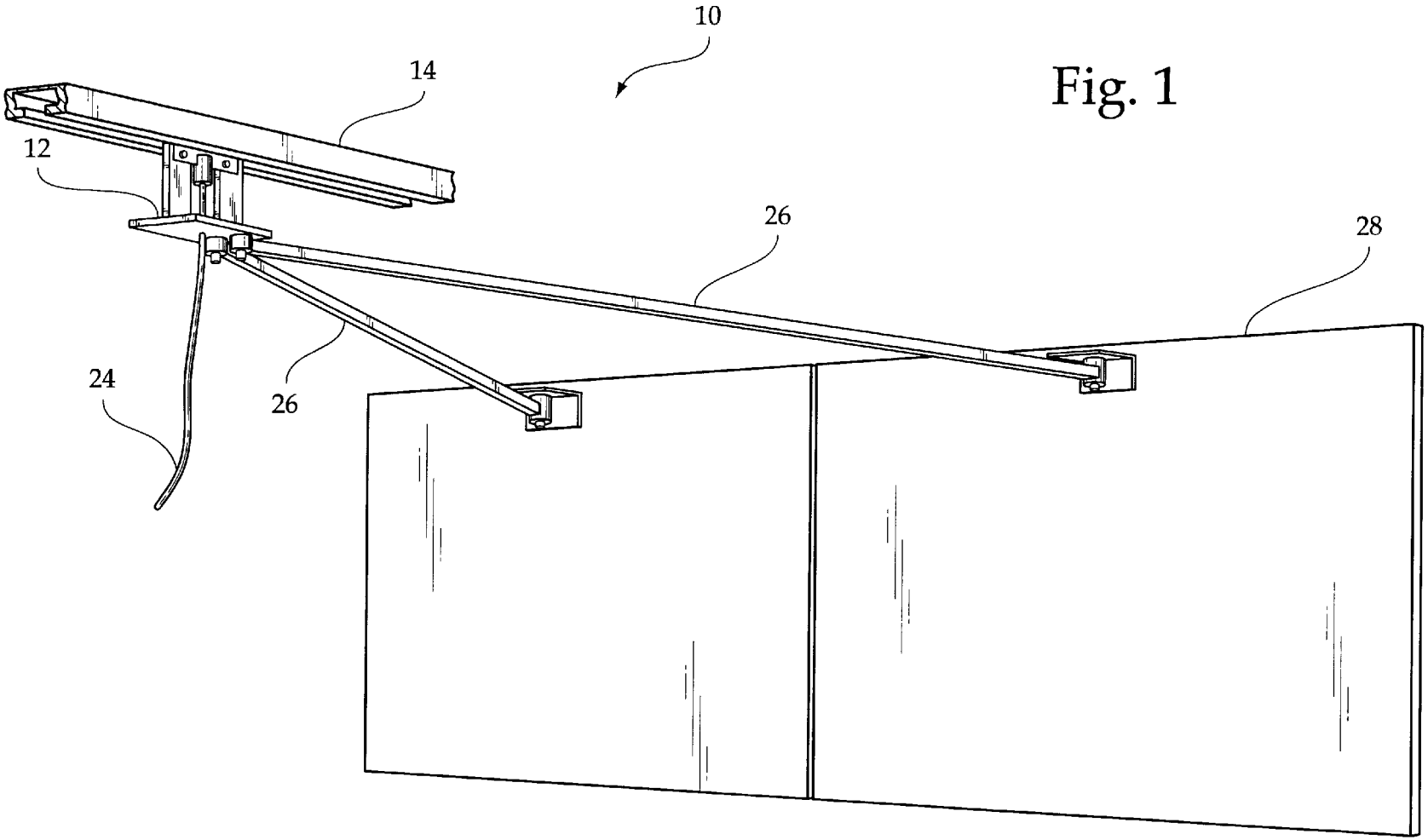
FIG. 1 is a perspective view of the preferred embodiment of the adapter for electric garage door openers constructed in accordance with the principles of the present invention.
Figure 2:
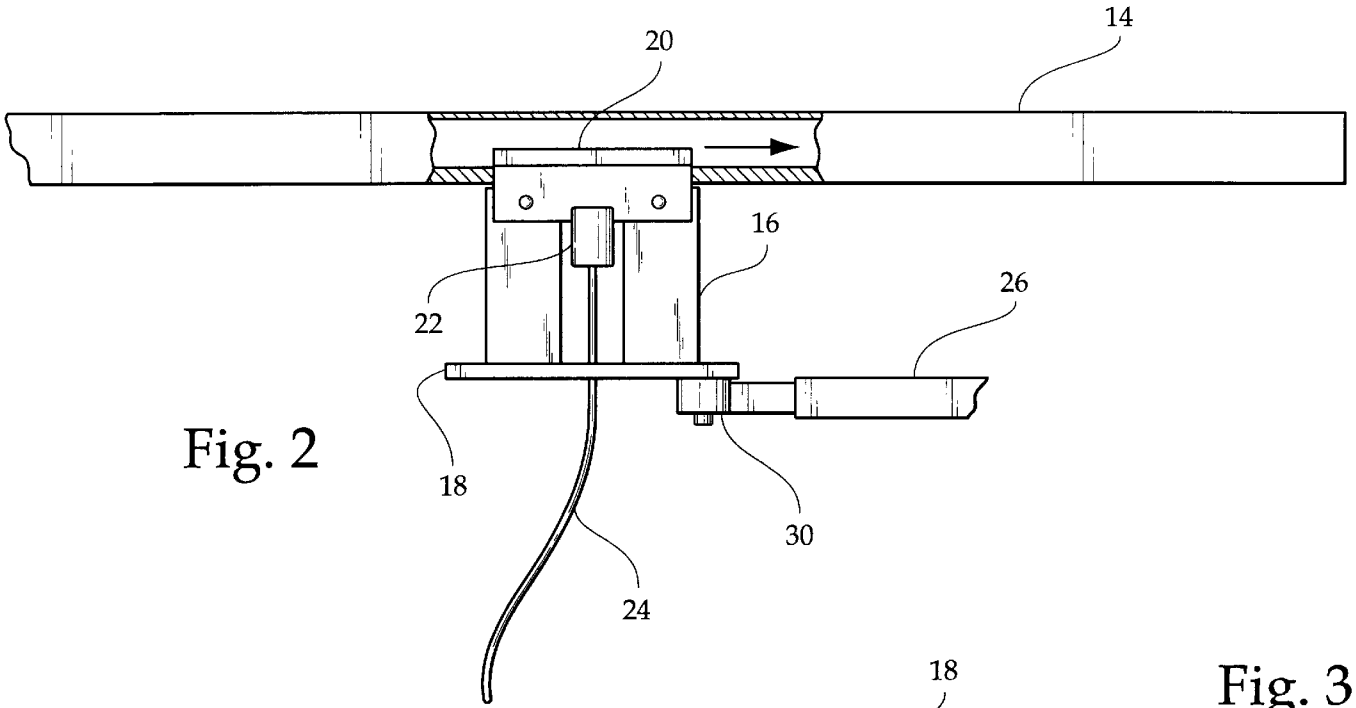
FIG. 2 is a side view of the sliding portion of the present invention illustrated in place within a track of the garage door opener.
Figure 3:
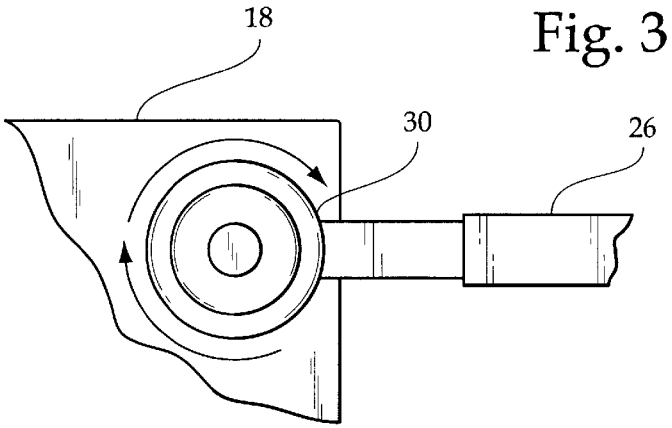
FIG. 3 is a partial bottom plan view of the sliding portion with a support bar pivotally coupled thereto.

With reference now to the drawings, and in particular, to FIGS. 1 through 5 thereof, the preferred embodiment of the new and improved adapter for electric garage door openers embodying the principles and concepts of the present invention and generally designated by the reference number 10 will be described.

Specifically, it will be noted in the various figures that the device relates to an adapter for electric garage door openers for allowing a standard electric garage door opener to open and close a pair of outwardly opening garage doors. In its broadest context, the device consists of a sliding portion and a pair of support bars. Such components are individually configured and correlated with respect to each other so as to attain the desired objective.

The sliding portion 12 is adapted for coupling with the track 14 of the electric garage door opener. Note FIGS. 1 and 2. The sliding portion 12 includes a vertical plate 16 and a horizontal plate 18. The vertical plate 16 has an upper end and a lower end. The horizontal plate 18 has an upper surface and a lower surface. The lower end of the vertical plate 16 is secured to the upper surface of the horizontal plate 18 whereby the vertical plate 16 extends upwardly from the horizontal plate 18 in an orthogonal relationship. The sliding portion 12 includes a sliding member 20 slidably coupled with the upper end of the vertical plate 16. The sliding member 20 has an upper end coupled with the track 14 of the electric garage door opener. The sliding member 20 has a cylindrical member 22 extending downwardly therefrom. The cylindrical member 22 has a release rope 24 secured thereto whereby pulling on the rope 24 will release the sliding member 20 from the track 14. The pulling of the release rope 24 enables the sliding member to slide manually within the track 14. By releasing the release rope 24, the sliding member 24 will re-engage the track 14. The track 14 will include a screw or worm-type mechanism that will attach to the sliding member 20 to allow the sliding member 20 to move once the electric garage door opener has been activated.

Figure 5:
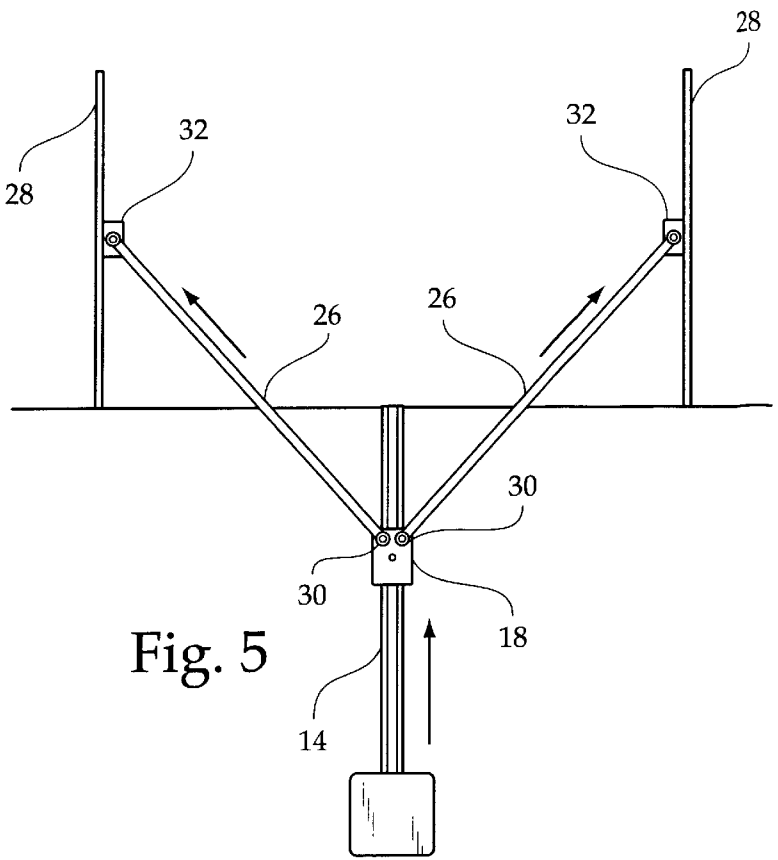
FIG. 5 is a plan view of the present invention illustrated with the garage door fully opened.
Figure 4:
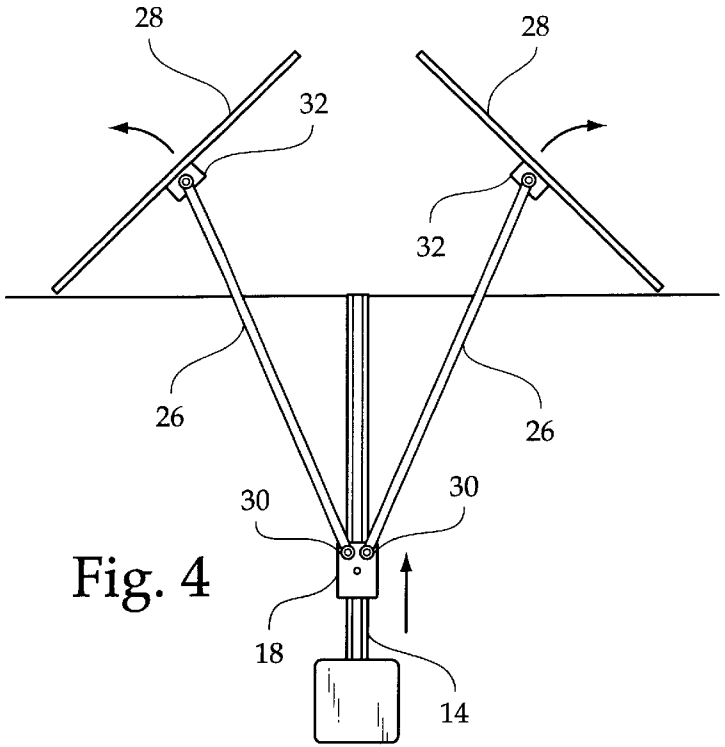
FIG. 4 is a plan view of the present invention illustrated opening a garage door.

The pair of support bars 26 extend between the sliding portion 20 and the pair of outwardly opening garage doors 28. Note FIGS. 1, 4 and 5. The support bars 26 each have inner ends 30 pivotally coupled with the lower surface of the horizontal plate 18 of the sliding portion 12. Note FIG. 3. The support bars 26 each have outer ends 32 pivotally coupled with the garage doors 28. The garage doors 28, as illustrated in FIGS. 4 and 5, are the type that are side by side and are pivotally disposed about a vertical axis.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adapter for electric garage door openers for allowing a standard electric garage door opener to open and close a pair of outwardly opening garage doors, whereby the garage doors are positioned in a side-by-side orientation and pivot on a vertical axis, and whereby the electric garage door opener includes a track, the adapter comprising, in combination:

a sliding portion adapted for coupling with the track of the electric garage door opener, the sliding portion including a vertical plate and a horizontal plate, the vertical plate having an upper end and a lower end, the horizontal plate having an upper surface and a lower surface, the lower end of the vertical plate being secured to the upper surface of the horizontal plate whereby the vertical plate extends upwardly from the horizontal plate in an orthogonal relationship, the sliding portion including a sliding member slidably coupled with the upper end of the vertical plate, the sliding member having an upper end coupled with the track of the electric garage door opener, the sliding member having a cylindrical member extending downwardly therefrom, the cylindrical member having a release rope secured thereto whereby pulling on the rope will release the sliding member from the track; and a pair of support bars extending between the sliding portion and the pair of outwardly opening garage doors, the support bars each having inner ends pivotally coupled with the lower surface of the horizontal plate of the sliding portion, the support bars each having outer ends pivotally coupled with the garage doors.

2. An adapter for electric garage door openers for allowing a standard electric garage door opener to open and close a pair of outwardly opening garage doors, whereby the garage doors are positioned in a side-by-side orientation and pivot on a vertical axis, and whereby the electric garage door opener includes a track, the adapter comprising, in combination:

a sliding portion adapted for coupling with the track of the electric garage door opener, the sliding portion including a sliding member slidably coupled with an upper end of a vertical plate, the sliding member having a cylindrical member extending downwardly therefrom, the cylindrical member having a release rope secured thereto whereby pulling on the rope will release the sliding member from the track; and a pair of support bars extending between the sliding portion and the pair of outwardly opening garage doors.

* * * * *